US006793608B2

(12) United States Patent
Goldberg et al.

(10) Patent No.: US 6,793,608 B2
(45) Date of Patent: Sep. 21, 2004

(54) STATIONARY EXERCISE BICYCLE

(75) Inventors: Johnny Goldberg, Montecito, CA (US); John R. Baudhuin, Santa Monica, CA (US)

(73) Assignee: Mad Dogg Athletics, Inc., Venice, CA (US)

( * ) Notice: Subject to any disclaimer, the term of this patent is extended or adjusted under 35 U.S.C. 154(b) by 12 days.

(21) Appl. No.: 10/092,958

(22) Filed: Mar. 7, 2002

(65) Prior Publication Data

US 2002/0168792 A1 Nov. 14, 2002

Related U.S. Application Data

(63) Continuation-in-part of application No. 09/672,197, filed on Sep. 28, 2000, which is a continuation of application No. 09/019,352, filed on Feb. 2, 1998, now Pat. No. 6,155,958, which is a continuation of application No. 08/736,976, filed on Oct. 25, 1996, now Pat. No. 5,722,916, which is a continuation of application No. 08/391,438, filed on Feb. 21, 1995, now abandoned, which is a continuation of application No. 07/969,765, filed on Oct. 30, 1992, now Pat. No. 5,423,728.

(51) Int. Cl.[7] ..... A63B 21/00
(52) U.S. Cl. ..... 482/57
(58) Field of Search ..... 482/57–65

(56) References Cited

U.S. PATENT DOCUMENTS

| | | | | | |
|---|---|---|---|---|---|
| 562,198 | A | | 6/1896 | Robinson | 482/52 |
| 588,166 | A | | 8/1897 | McCoy | 74/551.1 |
| 633,534 | A | | 9/1899 | Read | 280/261 |
| 635,082 | A | | 10/1899 | Stiles | 280/261 |
| 671,785 | A | | 4/1901 | Young et al. | 482/57 |
| 1,336,774 | A | | 4/1920 | Cooper | 482/57 |
| 1,507,554 | A | | 9/1924 | Cooper | 482/57 |
| 1,636,327 | A | | 7/1927 | Roe | 424/144 |
| 3,062,204 | A | | 11/1962 | Stefano | 128/25 |
| 3,511,097 | A | | 5/1970 | Corwin | 73/379 |
| D251,747 | S | | 5/1979 | Valentine et al. | |
| 4,188,030 | A | | 2/1980 | Hooper | |
| 4,296,940 | A | * | 10/1981 | Herbert | 280/278 |
| D280,117 | S | | 8/1985 | Collins | |
| D280,118 | S | | 8/1985 | Collins | |
| 4,577,860 | A | | 3/1986 | Matias | 272/73 |
| D284,596 | S | | 7/1986 | McNeil | |
| 4,632,386 | A | | 12/1986 | Beech | 272/73 |
| D289,782 | S | | 5/1987 | Szymski et al. | |
| D291,462 | S | * | 8/1987 | Aalto | D21/667 |
| D292,304 | S | | 10/1987 | Ostrom | |
| 4,768,777 | A | | 9/1988 | Yang | 272/73 |
| 4,772,069 | A | | 9/1988 | Szymski | 297/195 |
| 4,824,102 | A | | 4/1989 | Lo | 272/73 |
| 4,880,225 | A | | 11/1989 | Lucas et al. | 272/73 |
| 4,902,001 | A | | 2/1990 | Balbo | |
| 4,915,374 | A | | 4/1990 | Watkins | 272/73 |
| 4,936,570 | A | * | 6/1990 | Szymski et al. | 482/57 |
| 5,000,469 | A | | 3/1991 | Smith | 280/261 |
| 5,145,477 | A | | 9/1992 | Han | 482/57 |
| 5,232,422 | A | | 8/1993 | Bishop, Jr. | 482/57 |
| 5,336,147 | A | | 8/1994 | Sweeney, III | 482/57 |
| 5,423,728 | A | * | 6/1995 | Goldberg | 482/57 |
| 6,152,861 | A | * | 11/2000 | Chen | 482/57 |

* cited by examiner

*Primary Examiner*—Stephen R. Crow
(74) *Attorney, Agent, or Firm*—Jones Day

(57) ABSTRACT

A novel stationary exercise bicycle and method for exercising on that bicycle is disclosed. The novel bicycle, comprising a frame having front and rear sockets, a seat mounted into the rear socket, and a handlebar mounted in the front socket, can advantageously be adjusted so that a rider can adopt different riding positions to simulate outdoor bicycle riding conditions.

9 Claims, 6 Drawing Sheets

STATIONARY EXERCISE BICYCLE

CROSS REFERENCE TO RELATED APPLICATIONS

This is a continuation-in-part application of application Ser. No. 09/672,197, filed Sep. 28, 2000, which is a continuation of Ser. No. 09/019,352, filed on Feb. 2, 1998, now U.S. Pat. No. 6,155,958, which is a continuation of Ser. No. 08/736,976, filed on Oct. 25, 1996, now U.S. Pat. No. 5,722,916, which is a continuation of application Ser. No. 08/391,438, filed on Feb. 21, 1995, now abandoned, which is a continuation of Ser. No. 07/969,765, filed on Oct. 30, 1992, now U.S. Pat. No. 5,423,728.

BACKGROUND

Having a stationary exercise bicycle capable of simulating outdoor bike riding is valuable.

This invention relates to a stationary exercise bicycle which is sturdy and comfortable for use during extended periods of pedaling while standing or sitting or a combination thereof and thus capable of meeting the needs of the more demanding rider.

In recent years, the popularity of the stationary exercise bicycle has increased dramatically together with the fitness craze. Stationary exercise bicycles are conventionally made with straight, brazed round tubing. A problem associated with using the round tubing in these bicycles is their propensity for fragility. They easily snap under increased stress, for example, during periods when the rider is pedaling in a standing position or in an alternating standing and sitting pedaling position. Also, the bicycle structure does not provide for the best flexibility according to the preferences of the rider.

There is a need to provide a stationary exercise bicycle which is more durable and overcomes the problems of the prior art.

SUMMARY

The invented stationary exercise bicycle seeks to avoid the disadvantages associated with conventional stationary exercise bicycles.

According to the invention, the stationary exercise bicycle comprises a stable frame. Additionally, the frame comprises a front socket and a rear socket, and front and rear ground support elements. Also provided is a pedal mechanism on said frame.

Also, the bicycle comprises a detachable seat socket. A seat is mounted on a seat socket at a level above the pedal mechanism. The seat is mounted for movement fore and aft relative to the seat socket and upwardly and downwardly relative to the pedal mechanism.

Additionally, the stationary exercise bicycle comprises a handlebar mounted in the front socket. The handlebar includes at least two different handle means. One handle means includes spaced apart and outwardly directed elements. The second handle means includes an element inwardly located relative to the first handle means. The handlebar is adjustable in the front socket.

Further, in one preferred form, the frame comprises at least multiple upstanding posts. The posts are inter-engaging to form at least one triangulated or V-shaped structure between the ground support elements and one of the sockets.

Additionally, at least part of the front socket, rear socket, or seat socket are formed with a hollow member having a cross-section which is non-cylindrical.

The pedal mechanism may include a cog operative with an endless chain having slots for engagement with the cog. A ring guard is provided and protective of at least the interaction of the teeth of the cog with the endless chain. The ring guard is located internally of the perimeter defined by the endless chain.

The invented stationary exercise bicycle is strong and comfortable for the rider. The adjustability of the bicycle facilitates comfortable riding of the bicycle in multiple positions, for example, sitting, standing and different gripping positions. Moreover, it is stress-resistant so that it can be used by the rider in a standing position or in an alternating standing and sitting pedaling position for extended periods. Riders of this bicycle can simulate the aerobic effect of mountain bike racing.

According to another aspect of the invention, a method of exercising on the stationary exercise bicycle comprises adjusting the height and the fore and aft position of the seat and optionally also adjusting the height of the handlebars to facilitate riding the stationary exercise bicycle in multiple positions and then riding the bicycle in multiple positions to simulate different bicycle riding conditions.

Additionally, the invented stationary exercise bicycle is mobile and the parts, easily replaceable. Unlike conventional stationary exercise bicycles, the present invention utilizes regular bicycle components. The user can replace certain parts from conventional bicycle shops and thus service the present invention with conventional bicycle componentry. Further, unlike prior art stationary exercise bicycles, the present invention has four basic parts which are detachable and can be placed in a portable transport carrier for mobility.

According to a further aspect of the invention, the novel stationary exercise bicycle may comprise a deflector mounted underneath the front socket and a portion of a down tube coupling the front socket to the rear socket. The deflector advantageously prevents sweat, accumulating on a rider, from entering into the flywheel mechanism. In this manner, increased corrosive resistance is effected. In a similar manner, the novel bicycle may comprise a chain guard 56 that entirely encapsulates the chain, hub, and other working components so as to enhance corrosion resistance even further.

The down tube of the novel bicycle is preferably rectangular in shape and generally large in cross section. Such a structural difference advantageously permits better rigidity, lower cost, and by eliminating welds, an increased resistance to corrosion. Welds are eliminated by advantageously eliminating an arm or cross-element, further increasing rigidity and support. Moreover, this feature allows for a larger seat post member to be matingly engaged in the rear socket to advantageously accommodate taller riders.

The invention is now further described with reference to the accompanying drawings.

DRAWINGS

Figure 6A:
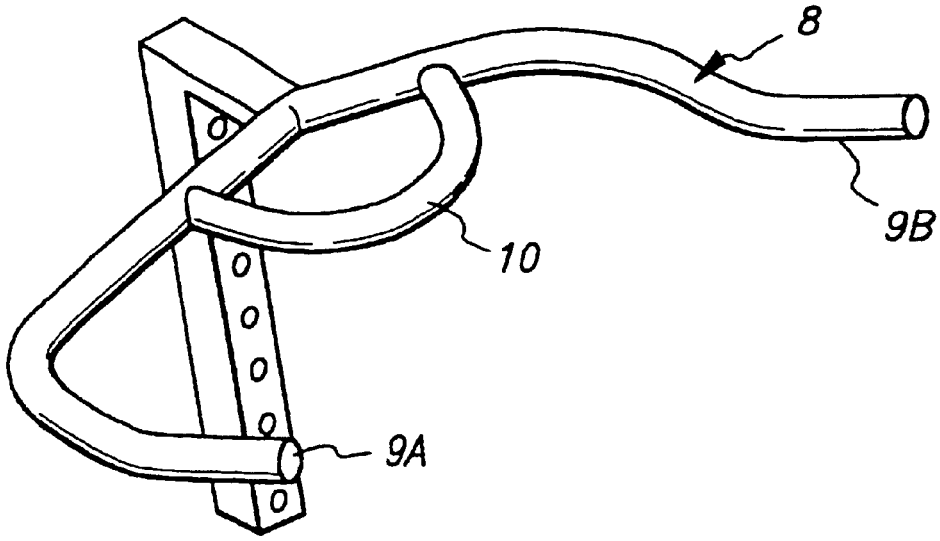
Figure 6B:
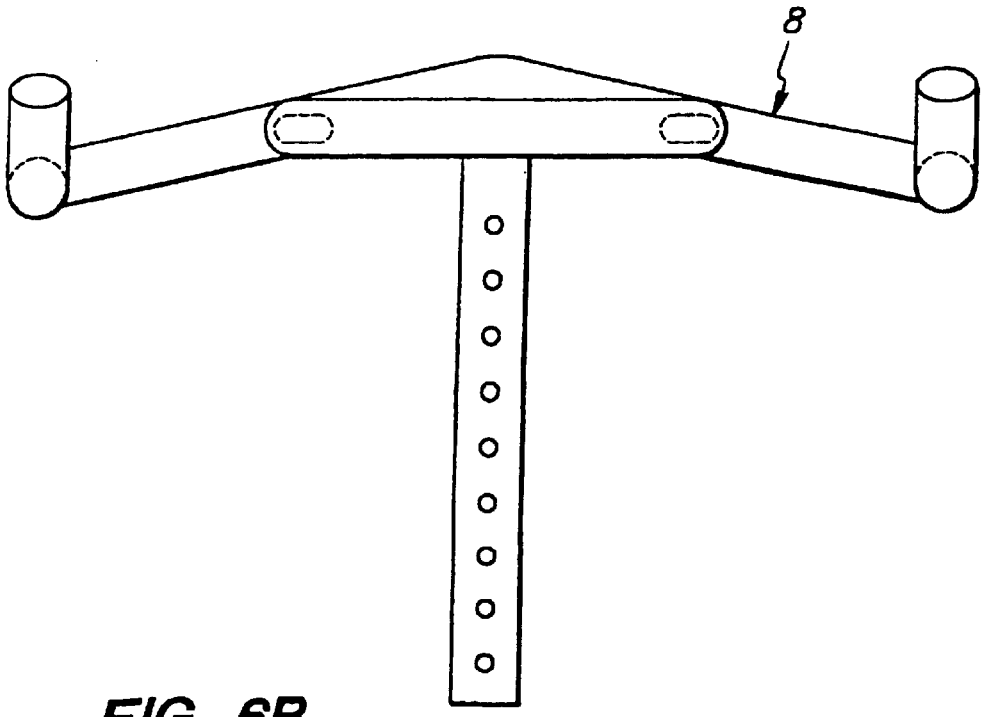
Figure 6C:
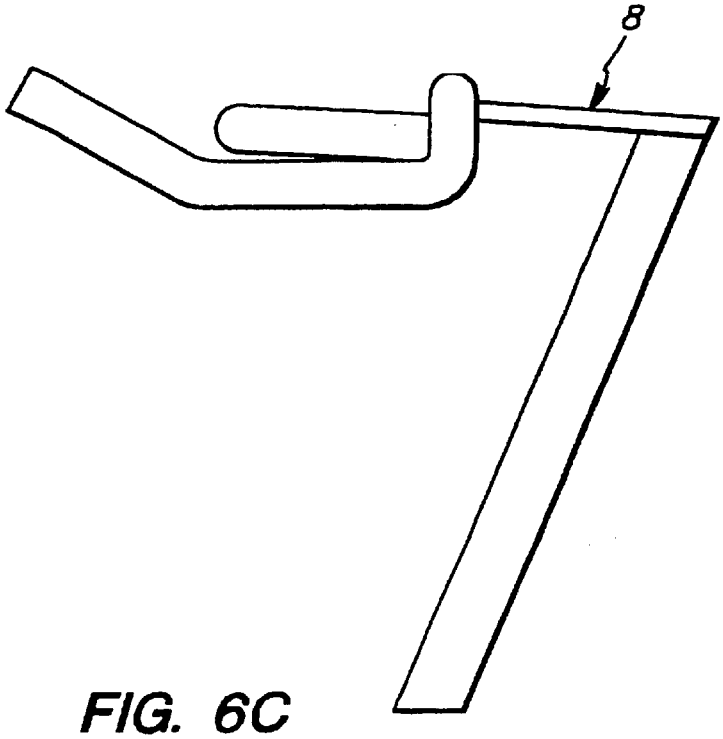
Figure 7:
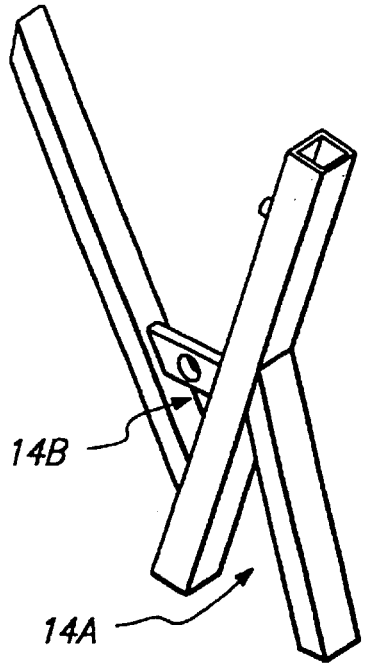
Figure 8:
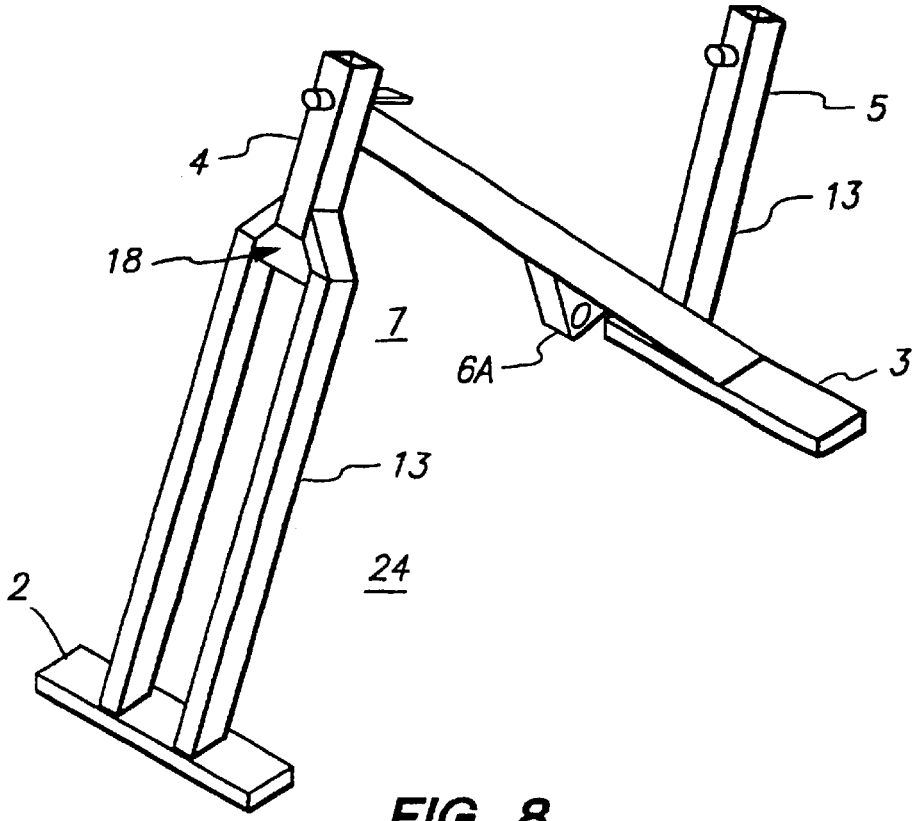

FIGS. 6A, 6B, and 6C are isometric, front and side views, respectively, of the adjustable and detachable handlebar including the forwardly extending prongs, the lateral bar, and the element inwardly located relative to the forwardly extending prongs;

FIG. 7 is an isometric view of the triangulated structure portion of the frame;

FIG. 8 is an isometric view of an alternative frame; and

Figure 9:
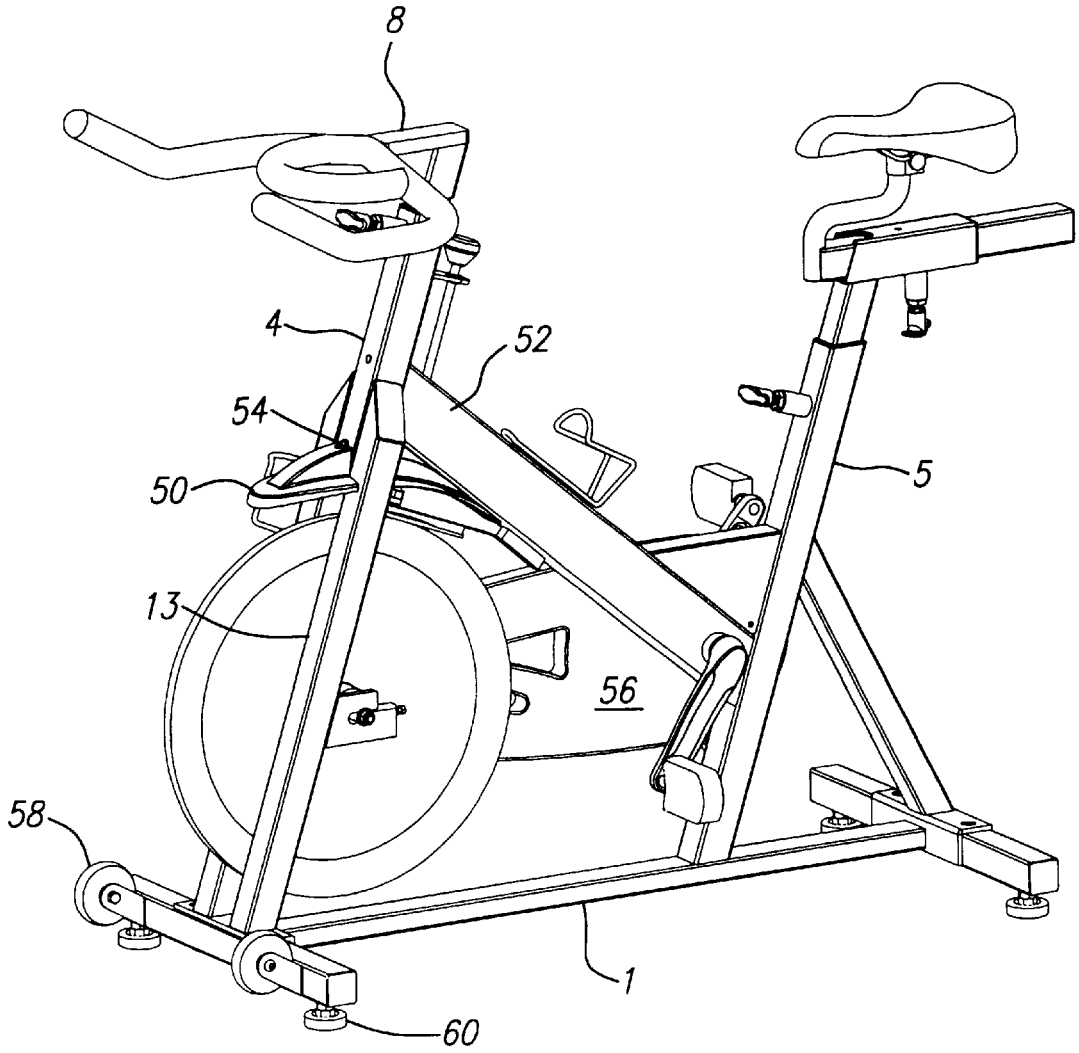

FIG. 9 is a perspective view of another preferred embodiment directed to a novel stationary bicycle.

DESCRIPTION

Figure 1:
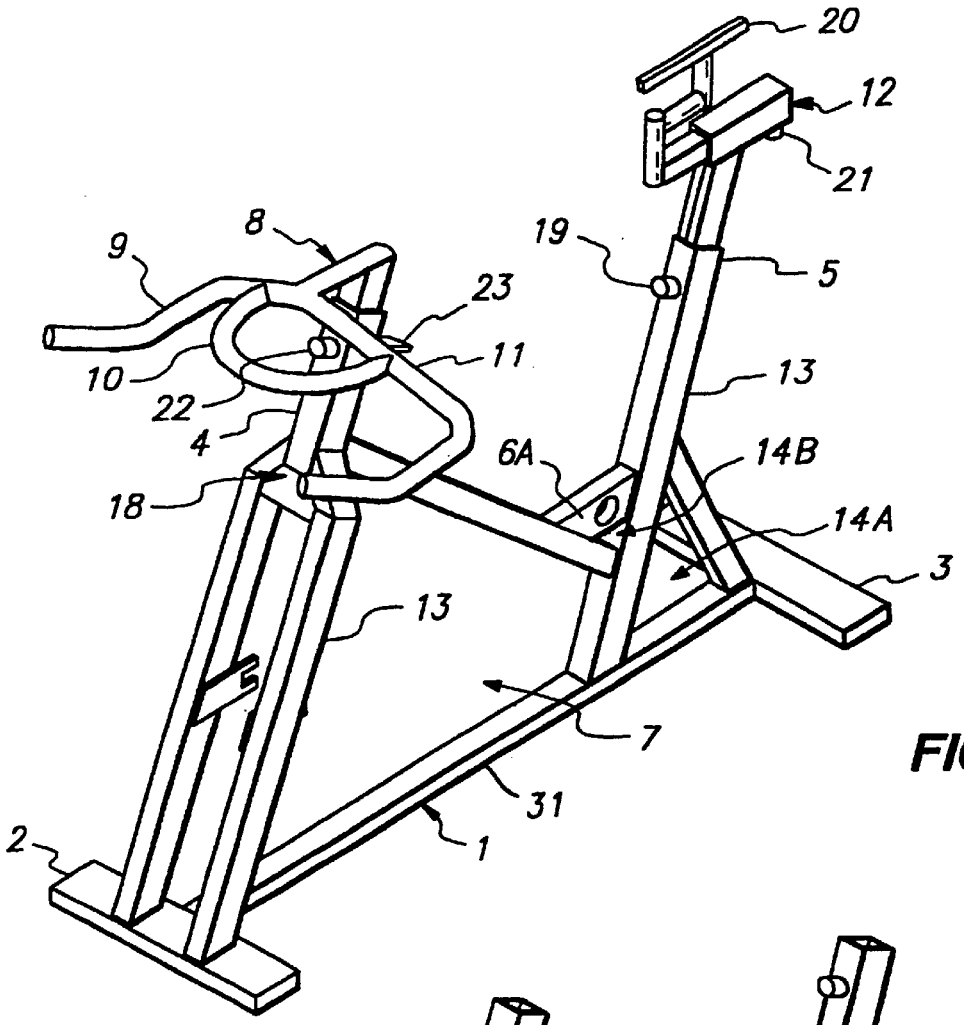
FIG. 1 is an isometric view of a frame for a stationary exercise bicycle.
Figure 2:
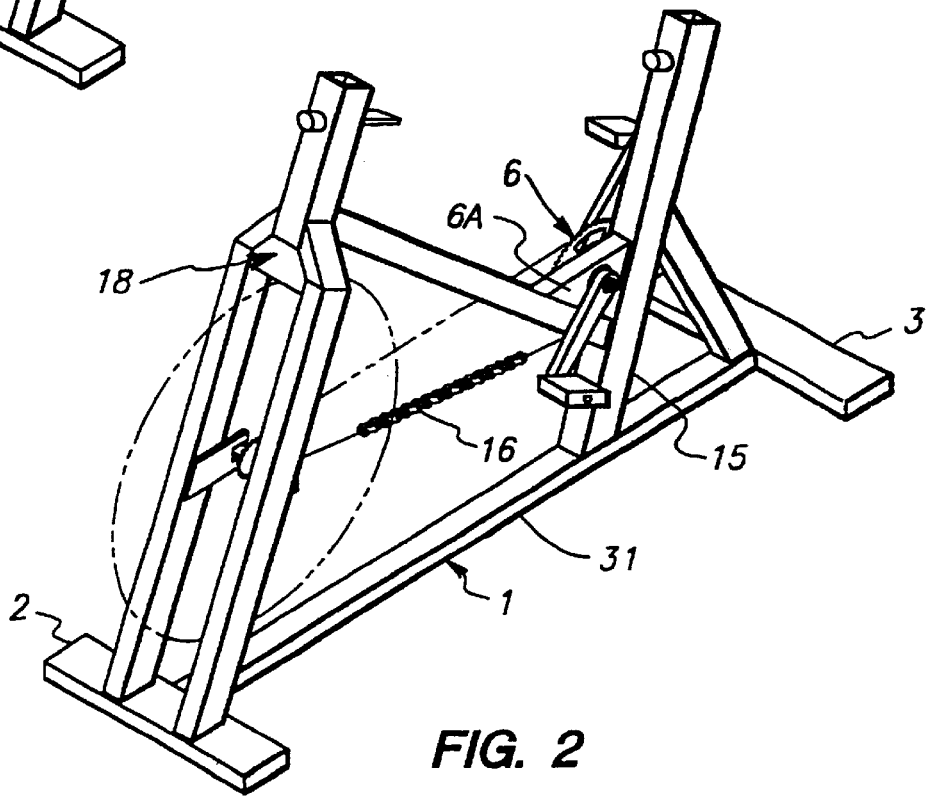
FIG. 2 is an isometric view of the pedal mechanism and a flywheel, both shown in phantom, including the ring guard, cog, and endless chain.

A stationary exercise bicycle comprises a frame 1 (FIG. 1) or 24 (FIG. 8). The frame has a central ground support element 31, front 2 and rear 3 ground support elements, a down tube 52, multiple upstanding posts 13, a front socket 4 and a rear socket 5 and a pedal mechanism 6. As discussed below and as shown in FIG. 2, pedal mechanism 6 generally includes a crankarm and crankset. The rear socket 5 is capable of receiving a seat socket 12. Further, a seat 20 may be mounted on the seat socket 12 at a level above the pedal mechanism 6. The seat 20 is mounted for movement fore and aft relative to the seat socket 12 and upwardly and downwardly relative to the pedal mechanism 6.

This stationary exercise bicycle further comprises a handlebar 8 mounted in the front socket 4. The handlebar 8 includes at least two different handle means 9 and 10. One handle means includes spaced apart and outwardly directed elements 9. The second handle means includes an element inwardly located 10 relative to the first handle means.

The outwardly directed handle means 9 have forwardly extending prongs 9A and 9B (FIG. 6A) which are directed axially away from the seat socket 12. The axially directed prongs 9A and 9B are connected with a lateral bar 11 of the handlebar 8 at one end and are free at an opposite end.

The inner handle means 10 is at least part of a closed ring. The ring is located between the outer handle prongs. Further, the ring is connected to a lateral bar 11 of the handlebar 8.

The closed ring may be a semi-circle. The axis for the semi-circle is located substantially about midway through the lateral bar 11 of the handlebar 8.

The handlebars have been designed with the user's handlebar position needs in mind. Because of the need for the different hand positions during the ride, the ring allows for different hand positions, movements, quick transition from sitting to standing, and standing back to sitting. It also allows, without the use of an attached arm pad, the ability to lie the forearm on the ring portion of the handlebar and simulate a real training cycling position.

The handlebar 8 may be connected to the frame 1 or 24 by the front socket 4. A handlebar pop pin 22 permits adjustment of the handlebar 8 according to the requirements of the rider. FIGS. 6A and 6B show the holes which permit the connecting member to be arrestable by a pop pin for adjustment.

Applicant contemplates that alternative handlebars may be connected to the frame 1 or 24 in accordance with the rider's needs.

The frame 1 (FIG. 1) or 24 (FIG. 8) further comprises at least multiple upstanding posts 13. In a preferred form, the posts inter-engage to form at least one triangulated structure 14 between the ground support elements 2 or 3 and one of the sockets.

The frame 1 includes at least two triangulated structures 7 and 14 between the sockets 4, 5, and 12. The two triangulated structures 7 and 14 have at least one common upstanding post 13 forming at least one wall of the triangulated structures 7 and 14. One of the triangulated structures 7 and 14 includes an arm or cross-element 6A intended to mount the pedal mechanism 6.

The upstanding posts 13 form part of the triangulated structure 7 and 14. Moreover, the upstanding posts 13 are all located at a non-horizontal, non-vertical axis.

The triangulated structures 7 and 14 include the rear triangle 14A which includes an inverted V-shaped section and which functions to stabilize the frame 1; the bottom bracket triangle 14B which includes an upstanding V-shaped section and which functions to stabilize the frame 1 so a rider can pedal standing; the front triangle-like structure 7 which functions to permit total range of motion; and a front fork triangle 18.

The rear triangle 14A is important as a stabilizing block. Unlike conventional stationary exercise bicycles, the small base of this triangle gives the bike its total rigidity in the rear.

The bottom bracket triangle 14B gives the central part of the stationary exercise bicycle its rigidity and form for standing. Further, arm or cross-element 6A allows for conventional pedal mechanisms (i.e., crankarm and crankset) to be used with a conventional clipless pedal or a regular bicycle pedal and toe clip.

The front triangle-like structure 7 is wide enough to house a flywheel (FIG. 2). The front triangle-like structure 7 gives the stationary exercise bicycle its total range of motion moving the flywheel in and out and giving the stationary exercise bicycle its base length or reel length from foot position to foot position.

The flywheel is connected to the frame 1 or 24 by the front forks 13 and the front fork triangle 18.

Further, at least part of the front socket 4, rear socket 5, or seat socket 12 are formed with a hollow member having a cross section being non-cylindrical. The sockets described herein permit a matingly shaped connecting member (such as the handlebar 8, the adjustable and detachable seat 20), the connecting member being arrestable by a pop pin 19, 21, or 22.

The hollow member may have a polygonal cross section (preferably quadratic). For example, in the illustrated example, the polygonal cross section is substantially square.

The seat is adjustable for height and connected to the seat socket 12. The seat post pop pin 19 permits height adjustment of the seat. The fore and aft saddle pop pin 21 permits adjustment of the seat 20 by sliding fore and aft in the seat socket 12.

Because of the adjustability of the seat and the handlebar, a rider theoretically may be as tall as 15 feet and weigh up to 900 pounds. The handlebar and seat adjustability provides for a versatile bicycle which can be used by persons of many different physiques, from small, light and short to large, tall and heavy.

Figure 3:
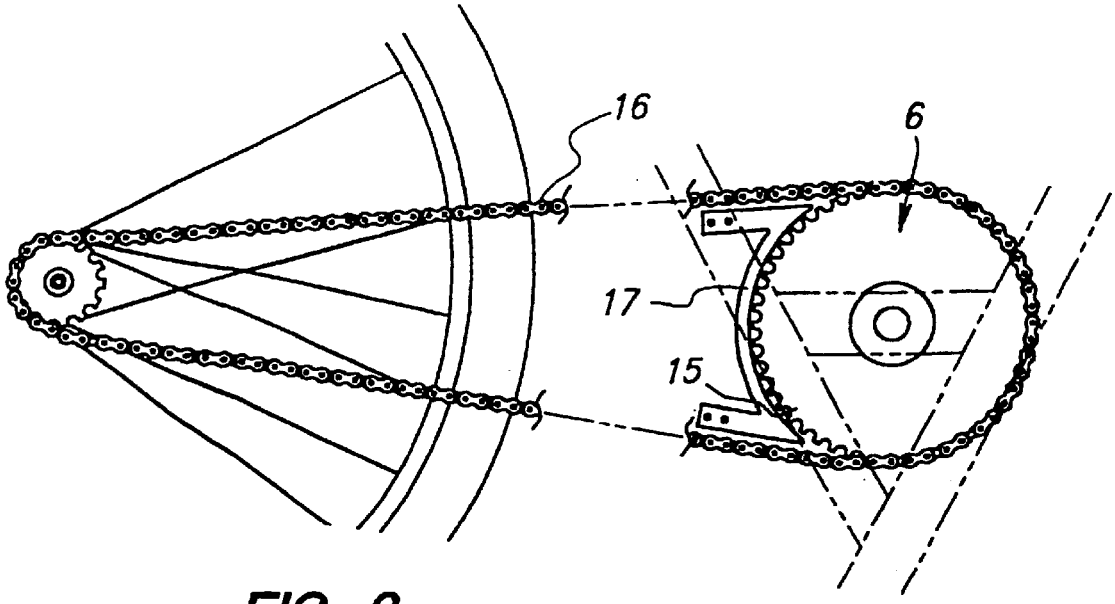
FIG. 3 is a detailed view of the ring guard in relation to the cog and frame.
Figure 4:
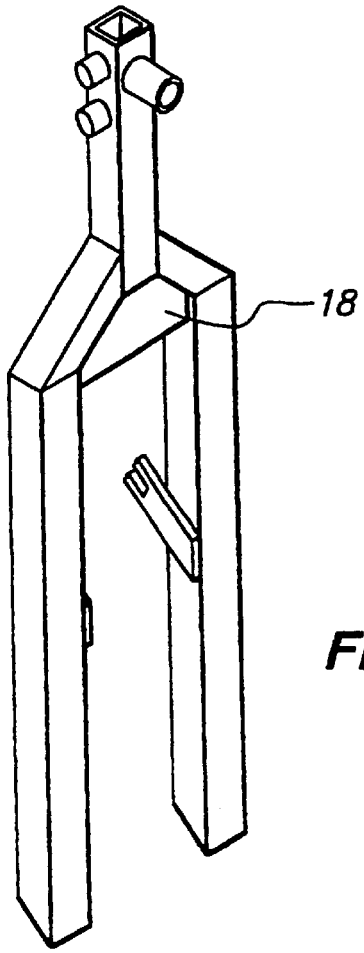
FIG. 4 is an isometric view of the front fork triangle and an upstanding post.
Figure 5:
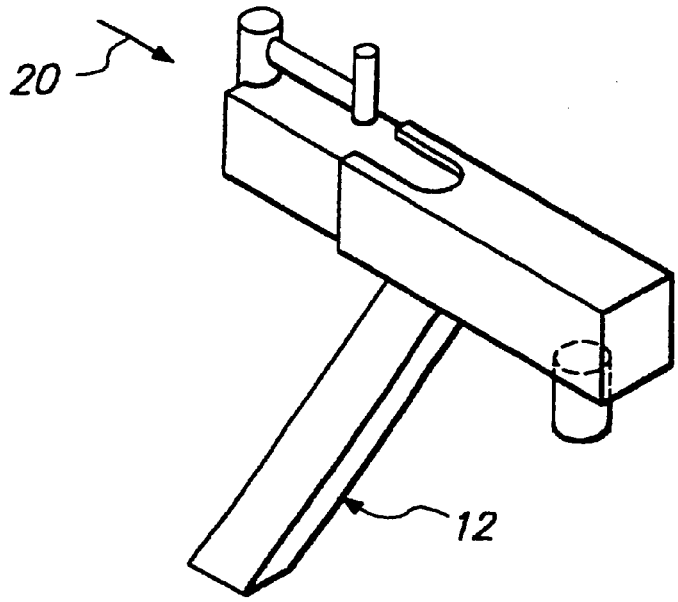
FIG. 5 is an isometric view of the seat socket and the connective member.

Referring now to FIG. 3, the pedal mechanism 6 includes a cog 15 operative with an endless chain 16 having slots for engagement with the cog 15. Additionally, the pedal mechanism 6 includes a ring guard 17 protective of at least the interaction of the teeth of the cog 15 with the endless chain 16. The ring guard 17 is located internally of the perimeter defined by the endless chain 16.

It would be desirable to provide attachments to the present invention. For example, a water bottle may be attached directly to the present invention or indirectly by means of a Velcro™ device or any carrier means for attaching the water bottle to the stationary exercise bicycle.

Additionally, an ergometer may be attached to the present invention. Also, a computer controlled energy measuring and indicating device may be attached to the present invention.

The stationary exercise bicycle may comprise a dual chain tension device which is adjustable while the rider is in motion. Moreover, the stationary exercise bicycle may comprise a cable resistance braking system which permits the rider to adjust the resistance of the flywheel. A resistance plate 23 may support a cable to the flywheel.

The length and width of the stationary exercise bicycle is appropriate for standing and sitting while pedaling. Additionally, the width is appropriate for pedaling while sitting and for stabilization when the rider pedals while standing and rocking the body from side to side.

In a preferred form, the triangulated structures 14A, 14B, 7 stabilize the stationary exercise bicycle. These triangulated structures form the "integrity" structure of the stationary exercise bicycle.

The symmetry of this machine is very basic. The genius in the present invention is in its simplicity. The present invention simulates road conditions exactly as if the rider is pedaling a conventional, non-stationary bicycle.

Applicant contemplates many other examples of the present invention each differing by detail only. For example, there are many variations of the sockets described herein. The sockets described herein may not only permit a matingly shaped connecting member to fit inside (such as the handlebar 8, the adjustable and detachable seat 20), the connecting member being arrestable by a pop pin 19, 21, or 22. In fact, the matingly shaped connecting member may be a hollow into which the socket fits, e.g., the rear, front, or seat socket.

Additionally, the handlebar 8 may include at least two different handle means. One handle means includes spaced apart and outwardly directed elements 9. The second handle means may include an element (e.g., a closed ring) outwardly located relative to the first handle means.

Further, in one form, the frame may have a plurality of segments. Instead of a single unit, the frame may collapse into several units which permits even greater mobility of the stationary exercise bicycle for transport. Each unit of the frame may be re-assembled using bolts or any other type of well known connecting means.

FIG. 9 illustrates an example of the present invention that is substantially similar to the preferred embodiments shown in FIGS. 1–8. The structural differences of this embodiment, with their corresponding functional advantages, are set forth below.

Turning to FIG. 9, a deflector 50 can be seen mounted underneath the front fork triangle 18 extending toward a down tube 52. A fastening member 54, such as a screw, bolt, or the like, couples the deflector 50 to the front socket 4. The deflector 50 is preferably a one-piece unit made from a flexible polymeric material, allowing for this plastic piece to be economically manufactured via injection molding or similar process.

The deflector 50 advantageously prevents sweat, accumulating on a rider, from entering into the flywheel mechanism. In this manner, increased corrosive resistance is effected.

As shown in FIG. 9, the down tube 52 couples the front socket 4 to the rear socket 5. The down tube 52 may be rectangular in shape and generally large in cross section. Such a structural difference advantageously permits better rigidity and lower cost, and by eliminating welds, an increased resistance to corrosion. Welds may be eliminated by directly mounting the down tube 52 to the rear socket 5 and by directly mounting pedal mechanism 6 to the down tube 52 that may advantageously eliminate the arm or cross-element 6A as shown in FIG. 1 and FIG. 8. Such direct coupling further increases rigidity and support. Moreover, this feature allows for a larger seat post member to be matingly engaged in the rear socket 5 to advantageously accommodate taller riders.

FIG. 9 also illustrates a unique chain guard casing or encapsulation 56 disposed proximate the down tube 52. The chain guard casing 56 entirely encapsulates the chain, hub, and other working components (shown, for example, as chain 16 in FIG. 2) so as to further enhance corrosion resistance.

FIG. 9 also illustrates a cover or encapsulation 57 that may be attached to frame 1 at down tube 52 and rear socket 5. As shown, cover 52 may protect down tube 52 and rear socket 5, and the weld therebetween, from the sweat that may fall down from a rider. This is advantageous because without cover 57, sweat might accumulate at the weld between down tube 52 and rear socket 5.

The handlebar 8 of this embodiment preferably has rounded ends, as shown in FIG. 9, to enhance safety and provide an ergonomic benefit to the rider. The handlebar 8 is also preferably made from stainless steel to increase this part's resistance to corrosion.

As seen in FIG. 9, the posts or forks 13 are closer together compared to those shown in the prior drawing figures. This arrangement allows for better rigidity and increased corrosion resistance due to a tighter fit between the components.

Wheels 58 coupled to the frame 1 advantageously allow for easy portability of the novel stationary bicycle.

Leveling pads 60 add stability and allow the user to compensate for non-level surfaces.

Thus, while embodiments and applications of the novel and improved stationary exercise bicycle have been shown and described, it would be apparent to one skilled in the art that other modifications are possible without departing from the inventive concepts herein. The invention, therefore, is not to be restricted except in the spirit of the claims that follow.

What is claimed is:

1. A stationary exercise bicycle that allows a rider to adopt different riding positions, comprising:

a corrosion-resistant frame comprising a front socket, a rear socket, a pedal mechanism coupled to a flywheel, and a down tube coupling the front socket to the rear socket;

a deflector coupled to the frame extending toward the down tube for preventing sweat of a rider from contacting the flywheel;

a chainguard coupled to the frame that encapsulates the pedal mechanism for preventing sweat of a rider from contacting the pedal mechanism;

a cover mounted to the frame that covers a portion of the frame including parts of the down tube and the rear socket for preventing sweat of a rider from contacting that portion of the frame, and a handlebar mounted to the frame having multiple handles that allow the rider to adopt different riding positions.

2. The stationary exercise bicycle according to claim 1 wherein the down tube extends diagonally and linearly from the front socket to the rear socket and is mounted directly to the rear socket.

3. The stationary exercise bicycle according to claim 1 wherein the down tube is rectangular in shape.

4. The stationary exercise bicycle according to claim 1 wherein the deflector is a unitary plastic member.

5. The stationary exercise bicycle according to claim 1 wherein the front socket includes a front fork triangle and the deflector is mounted underneath the front fork triangle.

6. A stationary exercise bicycle comprising:

a base including a central ground support, a front ground support attached to the central ground support, and a rear ground support attached to the central ground support;

a front post including two forks attached to the base, and a handlebar socket attached to the forks thereby forming a front fork triangle;

a handlebar that is attached to the handlebar socket and that includes a plurality of handles to permit different riding positions;

a rear post that is attached to the base and that includes a seat socket;

a seat assembly attached to the seat socket;

a linear diagonally extending down tube having ends that are attached to the front post and the rear post, wherein the front post, the down tube and the base form a forward triangle;

a support member having ends that are attached to the base and the rear post, wherein the rear post, the support member and the base form a rearward triangle;

a flywheel mounted to the front post;

a pedal assembly mounted to the down tube and coupled to the flywheel;

a deflector attached to the front post that prevents a rider's sweat from contacting the flywheel;

a chainguard attached to down tube that prevents a rider's sweat from contacting the pedal assembly; and a cover mounted to the down tube and rear post that prevents a rider's sweat from contacting a portion of the down tube and rear post;

wherein the front fork triangle, the forward triangle and the rearward triangle provide rigidity to the bicycle.

7. The stationary exercise bicycle of claim 6 wherein the handlebar is adjustable.

8. The stationary exercise bicycle of claim 6 wherein the pedal assembly includes a crank arm mounted to the down tube, a cog mounted to the crank arm and a chain coupling the cog and the flywheel, wherein the cog and chain are encapsulated by the chainguard.

9. The stationary exercise bicycle of claim 6 wherein the cover prevents the rider's sweat from contacting a weld between the down tube and rear post.

* * * * *

US006793608C1

(12) EX PARTE REEXAMINATION CERTIFICATE (8388th)

United States Patent

Goldberg et al.

(10) Number: US 6,793,608 C1

(45) Certificate Issued: Jul. 5, 2011

(54) STATIONARY EXERCISE BICYCLE

(75) Inventors: Johnny Goldberg, Montecito, CA (US); John R. Baudhuin, Santa Monica, CA (US)

(73) Assignee: Mad Dogg Athletics, Inc., Venice, CA (US)

Reexamination Request:
No. 90/010,855, Feb. 9, 2010

Reexamination Certificate for:

| | |
|---|---|
| Patent No.: | **6,793,608** |
| Issued: | **Sep. 21, 2004** |
| Appl. No.: | **10/092,958** |
| Filed: | **Mar. 7, 2002** |

Related U.S. Application Data

(63) Continuation-in-part of application No. 09/672,197, filed on Sep. 28, 2000, now Pat. No. 6,468,185, which is a continuation of application No. 09/019,352, filed on Feb. 5, 1998, now Pat. No. 6,155,958, which is a continuation of application No. 08/736,976, filed on Oct. 25, 1996, now Pat. No. 5,722,916, which is a continuation of application No. 08/391,438, filed on Feb. 21, 1995, now abandoned, which is a continuation of application No. 07/969,765, filed on Oct. 30, 1992, now Pat. No. 5,423,728.

(51) Int. Cl.
*A63B 21/00* (2006.01)

(52) U.S. Cl. ..... 482/57

(58) Field of Classification Search ..... None
See application file for complete search history.

(56) References Cited

U.S. PATENT DOCUMENTS

| | | | |
|---|---|---|---|
| D299,732 | S | 2/1989 | Gustafsson |
| 5,423,728 | A | 6/1995 | Goldberg |

OTHER PUBLICATIONS

Pan's World International Ltd., "Fitness Range," 1984, pp. 1–12.

Schwinn Fitness Equipment & Change of Shape Catalog, 1995–1996, 4 pages.

*Primary Examiner*—William C Doerrler

(57) ABSTRACT

A novel stationary exercise bicycle and method for exercising on that bicycle is disclosed. The novel bicycle, comprising a frame having front and rear sockets, a seat mounted into the rear socket, and a handlebar mounted in the front socket, can advantageously be adjusted so that a rider can adopt different riding positions to simulate outdoor bicycle riding conditions.

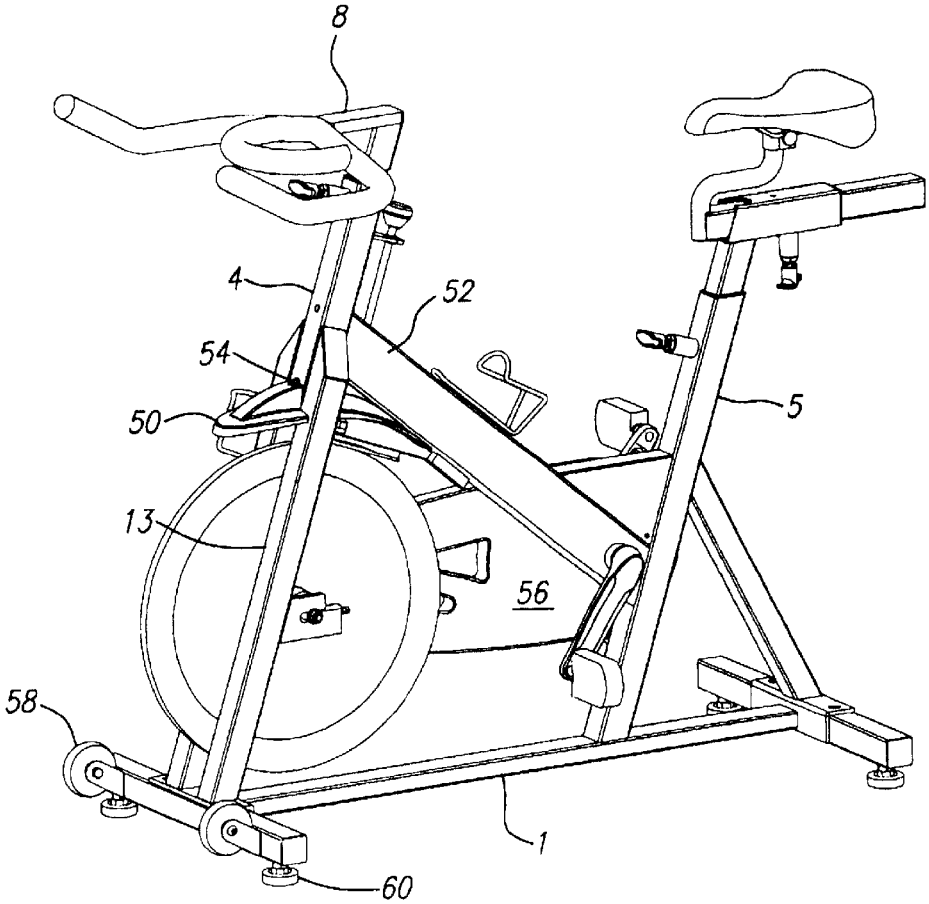

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 5 and 6 are determined to be patentable as amended.

Claims 2-4 and 7-9, dependent on an amended claim, are determined to be patentable.

1. A stationary exercise bicycle that allows a rider to adopt different riding positions *while riding the bicycle*, comprising:

a corrosion-resistant frame comprising a front socket, a rear socket, *a pair of forks, a flywheel located between the forks and coupled to the frame,* a pedel mechanism coupled to [a] *the* flywheel, and a down tube coupling the front socket to the rear socket;

a deflector *that is* coupled to the frame [extending] *at or near the top of the flywheel, that extends* toward the down tube*, that extends over the flywheel and that has a width extending beyond the interior surfaces of the forks* for preventing sweat of a rider from contacting the flywheel *at or near the top of the flywheel*;

a chainguard coupled to the frame that encapsulates the pedal mechanism for preventing sweat of a rider from contacting the pedal mechanism;

a cover mounted to the frame that covers a portion of the frame including parts of the down tube and the rear socket for preventing sweat of a rider from contacting that portion of the frame, and a handlebar mounted to the frame having multiple handles that allow the rider to adopt different riding positions*, including alternating sitting and standing positions while riding the bicycle.*

5. The stationary exercise bicycle according to claim 1 wherein the front socket includes a front fork triangle *including the pair of forks,* and the deflector is mounted underneath the front fork triangle *at the top of the flywheel and has a width that extends beyond the interior surface of the forks*.

6. A stationary exercise bicycle comprising:

a base including a central ground support, a front ground support attached to the central ground support, and a rear ground support attached to the central ground support;

a front post including two forks attached to the base, and a handlebar socket attached to the forks thereby forming a front fork triangle;

a handlebar that is attached to the handlebar socket and that includes a plurality of handles to permit different riding positions *while the rider is riding the bicycle, including alternating sitting and standing positions*;

a rear post that is attached to the base and that includes a seat socket;

a seat assembly attached to the seat socket;

a [linear] *linearly* diagonally extending down tube having ends that are attached to the front post and the rear post, wherein the front post, the down tube and the base form a forward triangle;

a support member having ends that are attached to the base and the rear post, wherein the rear post, the support member and the base form a rearward triangle;

a flywheel mounted to the front post;

a pedal assembly mounted to the down tube and coupled to the flywheel;

a deflector attached to the front post *that is positioned at or near the top of the flywheel and that has a width extending beyond the interior surfaces of the forks and* that prevents a rider's sweat from contacting the flywheel *at or near the top of the flywheel*;

a chainguard attached to *the* down tube that prevents a rider's sweat from contacting the pedal assembly; and a cover mounted to the down tube and rear post that prevents a rider's sweat from contacting a portion of the down tube and rear post;

wherein the front fork triangle, the forward triangle and the rearward triangle provide rigidity to the bicycle.

* * * * *